US008042329B2

(12) United States Patent
Saunders et al.

(10) Patent No.: US 8,042,329 B2
(45) Date of Patent: Oct. 25, 2011

(54) EXHAUST DISPERSING DEVICE FOR A TRUCK

(75) Inventors: Hamilton Gerald Saunders, Radford, VA (US); Hugh Thomas Dickinson, Greensboro, NC (US)

(73) Assignee: Volvo Group North America, LLC, Greensboro, NC (US)

( * ) Notice: Subject to any disclaimer, the term of this patent is extended or adjusted under 35 U.S.C. 154(b) by 941 days.

(21) Appl. No.: 12/011,639

(22) Filed: Jan. 28, 2008

(65) Prior Publication Data

US 2009/0188248 A1 Jul. 30, 2009

(51) Int. Cl.
*F01N 3/02* (2006.01)
*F01N 5/04* (2006.01)
*F01N 1/00* (2006.01)

(52) U.S. Cl. ..... 60/324; 60/317; 60/319

(58) Field of Classification Search ..... 60/313, 60/316, 317, 319, 324; 181/227, 228; D12/194
See application file for complete search history.

(56) References Cited

U.S. PATENT DOCUMENTS

| | | | | |
|---|---|---|---|---|
| 2,473,103 | A * | 6/1949 | Lathers | 181/269 |
| 3,012,495 | A * | 12/1961 | Miller | 454/344 |
| 3,022,717 | A * | 2/1962 | Webster | 454/4 |
| 4,106,290 | A * | 8/1978 | Johnson | 60/324 |
| 2009/0145119 | A1 * | 6/2009 | Farrell et al. | 60/324 |

* cited by examiner

*Primary Examiner* — Kenneth Bomberg
*Assistant Examiner* — Audrey K Bradley
(74) *Attorney, Agent, or Firm* — Martin Farrell; Michael Pruden

(57) ABSTRACT

An engine exhaust dispersing device includes a tubular member having a first portion formed as a generally cylindrical wall and adapted to be mounted in fluid communication with an exhaust outlet and a second portion formed as a longitudinally-sectioned cylindrical wall defining a longitudinally extending opening, and, a wedge surface formed on said second portion and protruding into the longitudinally extending opening, the wedge surface having an apex adjacent or in the first portion and a base at an end of the second portion, the base having a width substantially equal to a width of the second portion.

6 Claims, 2 Drawing Sheets

EXHAUST DISPERSING DEVICE FOR A TRUCK

FIELD OF THE INVENTION

The invention relates to exhaust systems for internal combustion engines, and more particularly, to a device for dispersing exhaust exiting a pipe.

BACKGROUND AND SUMMARY

During certain engine operating conditions, for example, regeneration of particulate filters in diesel engines, the exhaust temperature becomes sufficiently high to create potential problems to surrounding structures and vegetation. To prevent local high temperatures in the exhaust gas low, it is desirable to provide a device to disperse the exhaust gas over a wide area as it exits the exhaust outlet.

Known devices in the art include US Patent Application Publication No. 2007/0039318, U.S. Pat. No. 2,466,307 to Di Renna, U.S. Pat. No. 2,355,674 to Peters, et al., and U.S. Pat. No. 2,252,228 to Koch, Jr.

The invention provides an exhaust dispersing device that includes a tubular member having a first portion formed as a generally cylindrical wall and adapted to be mounted in fluid communication with an exhaust outlet and a second portion formed as a longitudinally-sectioned cylindrical wall defining a longitudinally extending opening, and, a wedge-shaped surface formed on or mounted on the second portion and protruding into the longitudinally extending opening, the wedge-shaped surface having an apex adjacent the first portion and a base at an end of the second portion, the base having a width substantially equal to a width of the second portion.

According to one embodiment of the invention, the wedge-shaped surface includes two substantially triangular planar surfaces oriented at a mutual angle and joined at a ridge, the ridge extending from the apex to the base and diverging from the second portion wall obliquely relative to a long axis of the tubular member.

According to another embodiment, the wedge-shaped surface is a longitudinal conical section.

According to yet another embodiment of the invention, the wedge-shaped surface includes a central planar part extending from the apex to the base and diverging from the second portion wall obliquely relative to a long axis of the tubular member and two substantially triangular side parts.

According to another aspect of the invention, one or more vents may be formed in the first portion adjacent the second portion. The vents allow ambient air to enter and dilute the exhaust gas flow before it is dispersed by the second portion.

BRIEF DESCRIPTION OF THE DRAWINGS

The invention will be better understood by reference to the following detailed description read in conjunction with the appended drawings, in which.

DETAILED DESCRIPTION

Figure 1:
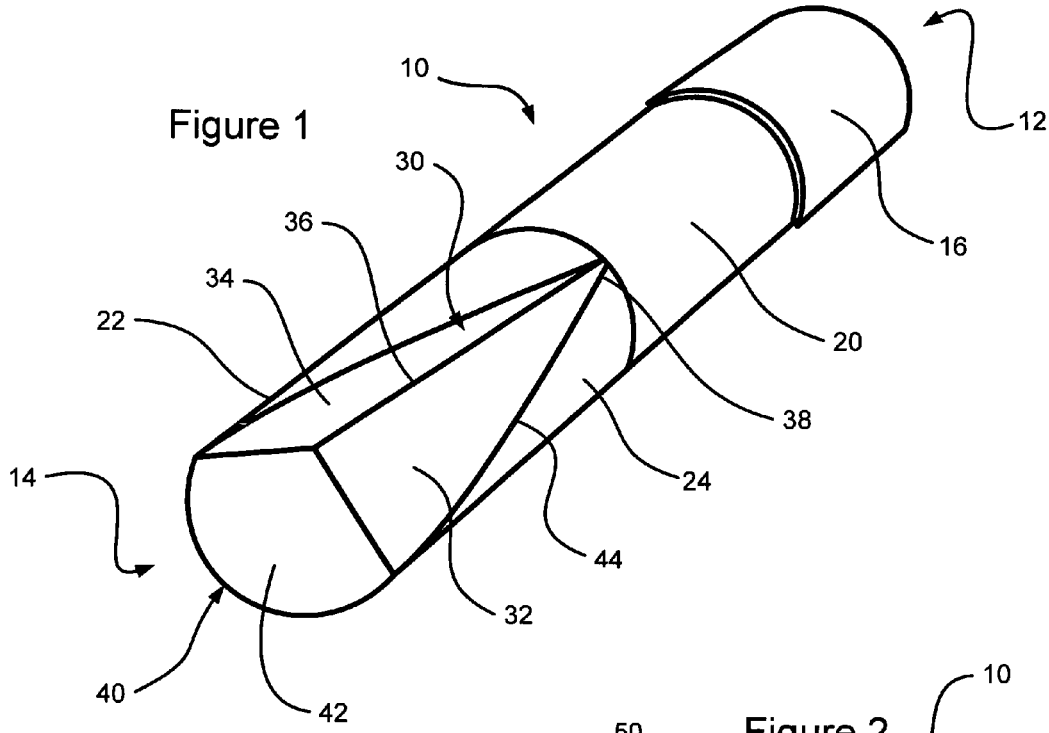
FIG. 1 is a perspective view of an exhaust dispersing device in accordance with one embodiment of the invention.
Figure 2:
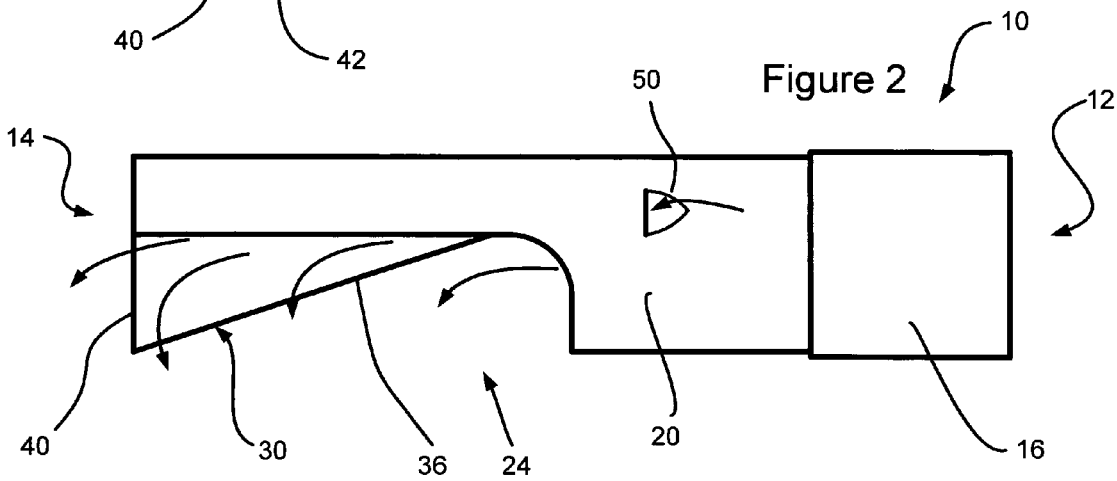
FIG. 2 is a side view of the device of FIG. 1.
Figure 3:
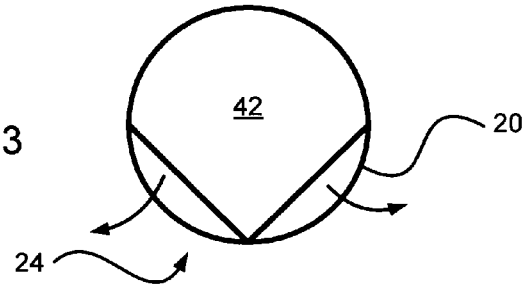
FIG. 3 is an end view of the device, looking in the direction from the left of FIG. 2.
Figure 4:
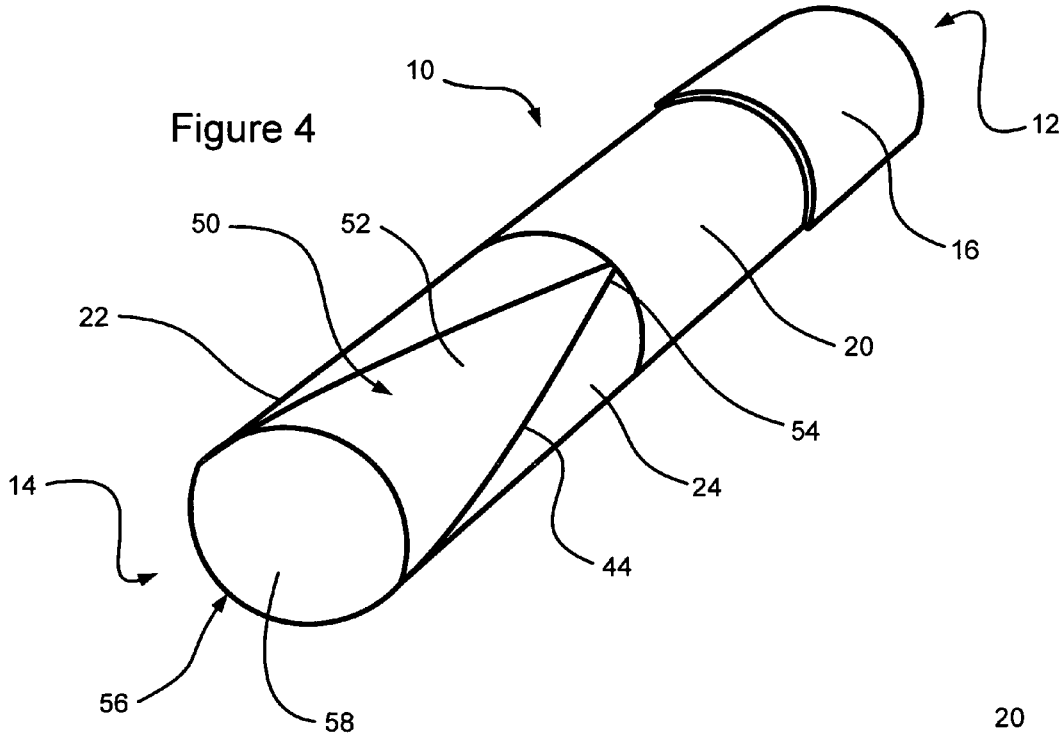
FIG. 4 is a perspective view of an alternative embodiment of the dispersing device; and, FIG. 5 is a perspective view of another alternative embodiment of the dispersing device having.
Figure 5:
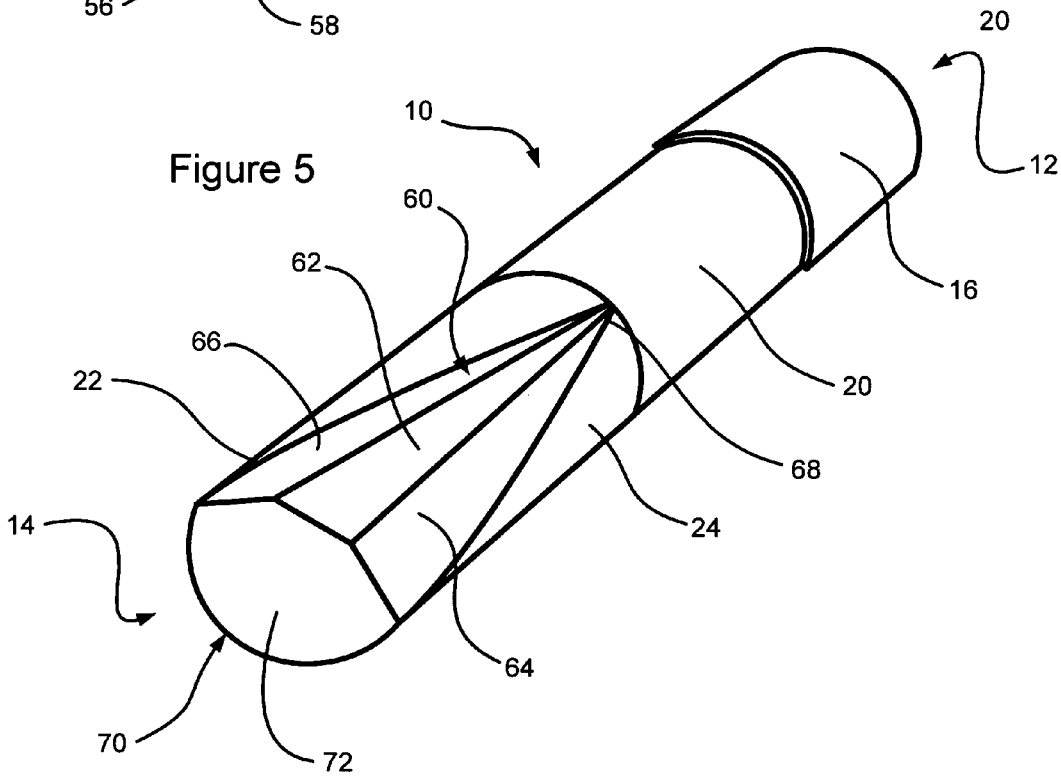

A dispersing device 10 in accordance with an exemplary embodiment of the invention is shown in FIGS. 1, 2, and 3. Alternative embodiments are illustrated in FIG. 4 and FIG. 5. In the figures, like components are identified by like reference characters.

The device is configured to be attached to the end of an exhaust pipe to serve as an outlet, and is of particular advantage with use on a tail pipe (an exhaust pipe extending horizontally and exhausting near the ground). As shown, the device is an elongated tube having an inlet end 12 and an outlet end 14.

The device 10 includes at the inlet end 12 a collar 16 for attaching the device to an exhaust pipe (not shown). The collar 16 is sized to receive therein a free end of an exhaust pipe, and may be secured to the pipe by a clamp or other device.

Adjacent the collar 16 is a first portion 20 or inlet portion of the device 10 to accept an exhaust gas flow from a connected exhaust pipe and guide the flow to an outlet portion 22. The first portion 20 in the illustrated embodiment is formed as a hollow cylindrical wall enclosing an interior space through which the exhaust gas may flow.

A second portion 22 of the device 10 is an outlet of the device. The second portion 22 is formed as a longitudinally sectioned cylindrical wall defining an elongated opening 24. Exhaust gas flowing through the inlet portion 20 is exhausted from the outlet opening 24.

To disperse exhaust gas as it exits the outlet opening 24, the device 10 includes a wedge element 30 disposed in the second portion 22. The wedge element 30 may be formed in the second portion 22 or mounted therein, as is convenient. The wedge element 30 shown in FIGS. 1, 2 and 3, includes two substantially triangular plates 32, 34 that are joined at an angle to one another. The triangular plates 32, 34 are connected at a central ridge 36 which extends in the longitudinal direction of the device 10. An apex or narrowed point 38 of the wedge element 30 is disposed in the first portion 20 on an inner surface of the wall. A base 40 of the wedge element 30 is disposed at the outlet end 14 of the device, and is closed by an end plate 42. The wedge element 30 widens or diverges in the flow direction (from inlet end 12 to outlet end 14).

The central ridge 36 extends from the apex 38 to the base 40 and is oriented obliquely relative to a longitudinal axis of the device 10. The wedge element 30 thus also increasingly protrudes from the outlet opening 24 in the flow direction.

As may be seen in FIG. 1, the edges 44, 46 of the respective triangular plates 32, 34 that are in contact with the cylindrical surface defined by the first portion 20 and second portion 22 are curved to accommodate the curvature of the surface.

As indicated in FIGS. 2 and 3 by the arrows, as exhaust gas flows through the device to the outlet opening 24, the gas is dispersed by the wedge element 30 to flow opposite the wedge element (downward in FIG. 2) and laterally from the wedge element (in FIG. 3).

The device 10 may include one or more vents 50 formed in the first portion 20 to induce a flow of ambient air to mix with and dilute the exhaust gas. A single vent 50 is shown in FIG. 2. Preferably, three vents 50 are formed and spaced equally about a perimeter of the first portion 20. The vents may be formed as apertures cut into the wall of first portion 20.

FIG. 4 is a perspective view of a device 10 according to invention including an alternative wedge element 50. The wedge element in FIG. 4 is shaped as a section of a cone, and provides a single curved surface 52 to deflect and disperse exhaust gas from the outlet opening 24. As in the embodiment of FIG. 1, an apex 54 of the cone section wedge element 50 is disposed in the first portion 20 of the device 10, and a base 56 of the wedge element is disposed at the outlet end 14 and closed by an end plate 58. Similar to the wedge 30 of FIG. 1, the wedge element 50 expands in the flow direction of the device 10 and forces exhaust to disperse laterally and away from the wedge element.

FIG. 5 is a perspective view of a device 10 including another alternative wedge element 60. The wedge element 60 is formed with a central triangular surface 62 and two triangular surfaces 64, 66 connected on either side of the central triangular surface to define an elongated pyramidal section. The pyramidal section includes an apex 68 disposed in the first portion 20 of the device 10 and a base 70 disposed at the outlet end 14. The base 70 is closed by an end plate 72. As in the previously described embodiments, the wedge element 60 forces exhaust flow to diverge and spread as it exits the outlet 24 of the device 10.

The invention has been described in terms of preferred and illustrative principles and embodiments. Those skilled in the art will understand that equivalents may be substituted for the components described here without departing from the scope of the invention defined by the appended claims.

What is claimed is:

1. A dispersing device for a vehicle exhaust outlet, comprising:

a tubular member having a first portion formed as a generally cylindrical wall and adapted to be mounted in fluid communication with an exhaust outlet and a second portion formed as a longitudinally-sectioned cylindrical wall defining a longitudinally extending opening, and a wedge element disposed in said second portion and protruding into the longitudinally extending opening, the wedge element having an apex adjacent the first portion and a base at an end of the second portion, the base having a width substantially equal to a width of the second portion, wherein the wedge element includes two substantially triangular planar surfaces joined at a ridge, the ridge extending from the apex to the base and diverging from the second portion obliquely relative to a long axis of the tubular member.

2. The device as claimed in claim 1, further comprising vents formed in the first portion.

3. The device as claimed in claim 1, wherein the first portion includes a collar configured to receive a free end of an exhaust pipe.

4. A dispersing device for a vehicle exhaust outlet, comprising:

a tubular member having a first portion formed as a generally cylindrical wall and adapted to be mounted in fluid communication with an exhaust outlet and a second portion formed as a longitudinally-sectioned cylindrical wall defining a longitudinally extending opening, and a wedge element disposed in said second portion and protruding into the longitudinally extending opening, the wedge element having an apex adjacent the first portion and a base at an end of the second portion, the base having a width substantially equal to a width of the second portion, wherein the wedge element includes a central planar part extending from the apex to the base and diverging from the second portion obliquely relative to a long axis of the tubular member and two substantially triangular side parts.

5. The device as claimed in claim 4, further comprising vents formed in the first portion.

6. The device as claimed in claim 4, wherein the first portion includes a collar configured to receive a free end of an exhaust pipe.

* * * * *